United States Patent [19]

Chen et al.

[11] 4,232,865

[45] Nov. 11, 1980

[54] RADIATION SENSING MOBILE TARGET GAME

[75] Inventors: Lim B. Chen; Lim L. Cher, both of Hong Kong, Hong Kong

[73] Assignee: Cybiotronics Limited, Hong Kong, Hong Kong

[21] Appl. No.: 890,493

[22] Filed: Mar. 27, 1978

[51] Int. Cl.[3] ..... F41J 5/02; F41J 7/00; F41J 9/02

[52] U.S. Cl. ..... 273/311; 273/312; 273/386

[58] Field of Search ..... 273/105.2, 101.1, 102.2 R, 273/310, 311, 312; 46/256

[56] References Cited

U.S. PATENT DOCUMENTS

| | | | |
|---|---|---|---|
| 2,148,612 | 2/1939 | French | 273/101.1 |
| 2,629,598 | 2/1953 | Hooker | 273/101.1 |
| 2,838,876 | 6/1958 | Smith | 46/256 |
| 3,226,121 | 12/1965 | Goldfarb | 273/86 B |
| 3,308,577 | 3/1967 | Holt | 46/256 |
| 3,314,189 | 4/1967 | Carroll . | |
| 3,675,925 | 7/1972 | Ryan et al. | 273/101.2 |
| 3,849,931 | 11/1974 | Gulley | 46/256 X |
| 3,877,157 | 4/1975 | Ashferd et al. | 273/101.1 X |
| 3,907,433 | 9/1975 | Nault | 273/101.1 X |
| 4,103,892 | 8/1978 | Hinze | 273/101.1 |

FOREIGN PATENT DOCUMENTS

| | | | |
|---|---|---|---|
| 2006570 | 2/1970 | Fed. Rep. of Germany | 46/256 |
| 848454 | 9/1960 | United Kingdom | 46/256 |
| 1160438 | 8/1969 | United Kingdom | 46/256 |
| 1174002 | 12/1969 | United Kingdom | 46/256 |
| 1207495 | 10/1970 | United Kingdom | 46/256 |

*Primary Examiner*—Anton O. Oechsle

*Attorney, Agent, or Firm*—Louis E. Marn; Elliot M. Olstein

[57] ABSTRACT

A game has at least one radiation emitter for manipulation by a player and a mobile target carrying a sensing means responsive to receive radiation, the target being moved in response to sensed radiation. In one embodiment there are two sensors each responsive to the radiation emitted by an individual radiation emitter controlled by an individual player. In another embodiment, the mobile target normally moves in a circular path and is responsive to sensed radiation to move in a tangential line of travel for a predetermined time. The mobile target may be provided with two sensors which, through control circuitry, cause the target to travel different predetermined distances dependent on which sensor receives radiation.

8 Claims, 3 Drawing Figures

RADIATION SENSING MOBILE TARGET GAME

The present invention relates to a game and is concerned in particular with a shooting game.

In accordance with the present invention, there is provided a game comprising radiation emitting means for manipulation by a player, a mobile target carrying sensing means responsive to the radiation of the emitting means and control means for controlling the velocity of the target in dependence upon the sensed radiation.

It is to be noted that the term "velocity" is being used in a strict sense to mean a vector dependent upon both the direction and the speed of movement. Thus, the sensing of emitted radiation may result in a change of velocity or direction of the mobile target.

For example, the target may be a vehicle which normally is at rest and which moves by a predetermined distance in response to the sensing of radiation. Alternatively, the target may be arranged to move in a circle under normal conditions and to travel along a tangent to the circle for a predetermined distance in response to detection of radiation, subsequently to revert to circular motion.

The game is suitable both as a test of skill and as shooting practice for a single player. In this mode of use, the object of the game is to determine the minimum number of shots, that is to say the minimum number of actuations of the radiation emitting means necessary to move the target a given distance in a predetermined direction.

Alternatively, the game may be used by two people in a competitive manner to determine the more accurate marksman. When used competitively, two radiation emitting means are provided, one for each player. If the target is normally stationary, then an accurate shot by one player may move the target a given distance in one direction and an accurate shot by the other player may result in movement of the target by the same distance in the opposite direction. The object of the game would then be to determine the first player capable of moving the target a given distance despite the opposite movement caused by the shots of the other player. It is possible in such an embodiment of the invention for the two light emitting means to differ from one and other and for a common sensing means to be capable of distinguishing between the two radiations. Thus, the radiations may consist of bursts of light of different frequency and/or duration. Alternatively, the radiation means may be the same for both players and a respective sensor may be embodied in the target for each player to aim at, whereupon, should a player miss his own sensor on the target and hit the opponents sensor he will not only fail to move the target in the desired direction but will move the target in the opposite direction.

It is also possible to provide several sensors on the target each operative to move the target by a different amount so that the more accurate a shot, the greater the distance moved.

When the target is arranged to move in a circle except in response to detection of radiation, it is again possible to provide competition between two players by providing a single sensor and similar radiation emitting means for the two players. The players may then be situated on opposite sides of the target so that by suitably timing the actuation of the radiation emitting means the players may arrange for the target to deviate into opposite directions.

The radiation emitting means may conveniently be light sources though they may emit other radiation such as infa-red. If light is emitted, the emitting means may be a laser gun. The radiation should be emitted in the form of a narrow beam in order that the marksmanship may be tested accurately.

In the preferred form of the invention, each light emitting means is a gun carrying a trigger which when pressed results in the emission of two consectutive pulses with a predetermined separation. Such a sequence of pulses may conveniently be detected by causing the first of the two detected pulses to trigger a monostable circuit having a quasi-stable state of duration greater than the separation of the two pulses and using the outputs of the monostable circuit to gate the second detected pulse to a control circuit for varying the velocity of the target.

The invention will now be described further, by way of example, with reference to the accompanying drawings in which.

Figure 1:
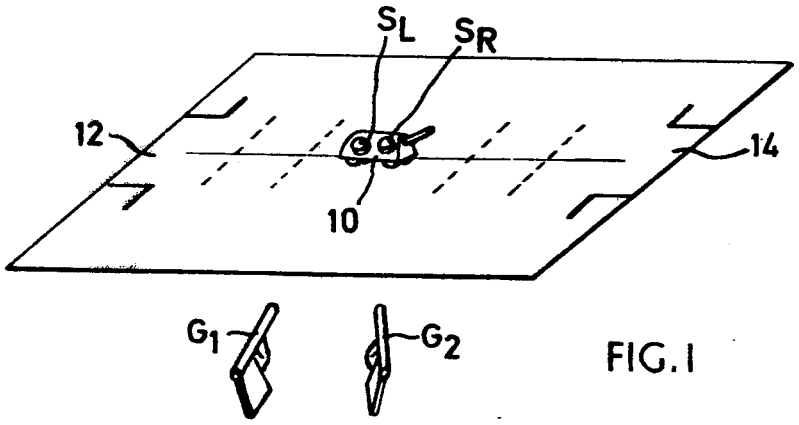
FIG. 1 is a sketch showing a mobile target arranged on a table and carrying two sensors responsible to the radiation emitted by two guns.

In FIG. 1, there is shown a mobile target 10 arranged on a table and carrying a motor (not shown) which is controlled by two sensors designated $S_L$ and $S_R$, respectively. Two players are each provided with a respective gun $G_1$ and $G_2$. Each player aims his gun on a respective one of the two detectors $S_L$ and $S_R$. In response to radiation, the detector $S_L$ causes the target 10 to move a predetermined distance to the left, as shown, whereas the detector $S_R$ results in a movement to the right. Goal areas 12 and 14 are marked up on the table and the winner of the two competitors is the one who causes the target to reach his respective goal.

The guns $G_1$ and $G_2$ may emit light or infa-red radiation and it is possible either to arrange for each detector only to be responsive to the radiation from a respective one of the two guns or to be responsive to both guns. In the former case a player cannot cause the target to move away from his goal and in the latter case a player aiming at the incorrect detector suffers a penalty in that the target moves in the opposite direction from that desired.

Figure 3:
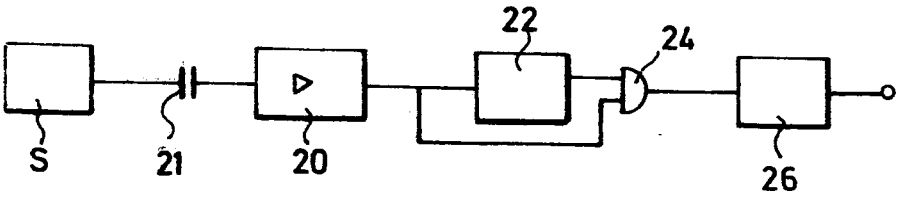
FIG. 3 is a block circuit diagram of a detector for detecting pairs of pulses emitted by a gun.

It is preferred that the gun in response to being triggered should emit two consecutive pulses having a predetermined separation. A circuit for detecting such a pair of pulses is shown in FIG. 3. A photo-detector S detects the two pulses and transmits its output signal by way of a capacitor 21 to an amplifier 20. The capacitor allows changes in the output of the photo-detector to be applied to the amplifier 20 whilst maintaining DC isolation. The output of the amplifier has the form of two saw-tooth like pulses which are applied to the triggering input of a monostable multivibrator 22. The first of these pulses serves to trigger the monostable multivibrator into its quasi-stable state so that when the second pulse arrives the monostable multivibrator 22 is in the high state.

Figure 2:
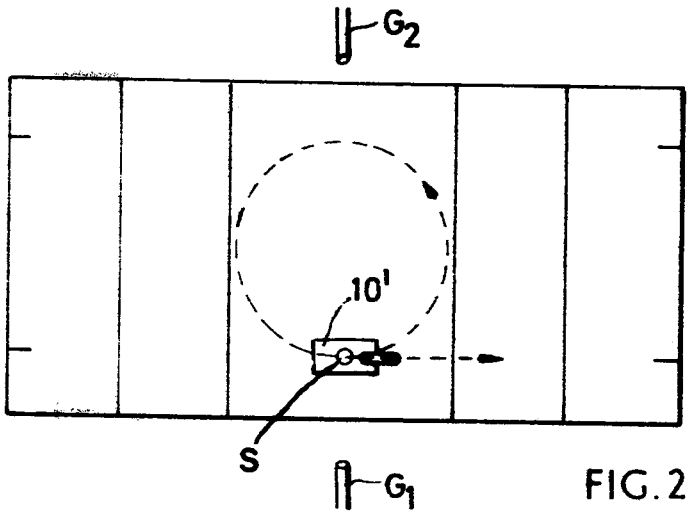
FIG. 2 is a sketch of a mobile target having a single detector arranged on a table and two guns to be fired by players disposed one on each side of the table.

An AND gate 24 is connected to the input and the output of the monostable multivibrator 22. When the second of the two pulses appears at the input of the monostable multivibrator 22 whilst the latter multivibrator is in its quasi-stable state, the output of the AND gate 24 is high and triggers a second monostable multivibrator 26 which serves to control the velocity of the mobile target. It will be appreciated that this and similar circuits known in the prior art are capable of discriminating between pulse pairs of different time separations and such circuits may therefore distinguish between the pulse pairs emitted by the respective guns. Referring now to FIG. 2, in this embodiment of the invention the mobile target 10' is in constant movement and defines circles. When a sensor S on the target 10' detects radiation by either of the two guns $G_1$ and $G_2$, it steers the target 10' to travel in a straight line which is tangential to the circle. The direction of movement will depend on the point in time when the sensor S detects radiation. Thus if the gun $G_1$ is triggered when the target is nearest the operator, the target 10' will move to the right, as viewed, so as to effect a maximum displacement in the direction of the goal to the right of the table. If the target is hit before it reaches the nearest point on the circle to the player, then the target will follow a straight line tending to move the target 10' to the right and towards the side of the player $G_1$. Conversely, if the target is hit later than this point, the target 10' will move along a line to bring it nearer the player using the gun $G_2$. The rules of the game may be such that when the target moves out of bounds the player responsible forfeits a point. This mode of operation in addition to requiring greater skill in that each player is aiming at a moving target, lends itself to a strategic planning of the game since it may be to a competitor's advantage to move a target a shorter distance in the desired direction whilst at the same time bringing the target nearer to his side of the field so as to facilitate subsequent shots and also to reduce the opponent's chances of hitting the target.

In an alternative embodiment, the boundaries may be solid limits and the target may be so designed as to rebound up on impact with a boundary so that no penalty is incurred by a player moving the target out of the field marked on the table.

If desired the target may carry a plurality of sensing means each operative to affect the velocity of the target to a different extent thus in an embodiment in which the target is normally stationary the sensing means may cause the target to move by different distances. In the embodiment where the target normally describes a circle each sensing means may cause the target to move in a straight line for a different length of time.

We claim:

1. A game for testing the ability of players, which comprises:

a mobile target;

means for emitting a narrow beam of radiation, said radiation emitting means comprising a gun emitting a single pair of pulses upon each actuation of a trigger thereof;

sensing means on said mobile target responsive to said radiation of said emitting means and comprising a radiation detector and a circuit for detecting said emitting pulses, said circuit including gating means for gating a second received pulse under the control of a first received pulse such that said circuit is only responsive to pulses of radiation having a predetermined separation in time;

drive means on said mobile target for displacing said mobil target; and control means for controlling said drive means in response to sensed radiation, said control means being set to cause said mobile target to undergo a predetermined change in velocity for a predetermined length of time in response to said sensed radiation.

2. The game as claimed in claim 1 wherein said mobile target is provided with a plurality of sensing means and wherein said control means is caused to control the velocity of said mobile target by differing amounts in response to radiation sensed by each of said sensing means.

3. The game as claimed in claim 1 and comprising two radiation emitting means and two sensing means and wherein said mobile target is caused to move a predetermined distance in one direction in response to said radiation being detected by a first of said sensing means and to move a predetermined distance in the opposite direction in response to detection of radiation by a second of said sensing means, said predetermined distance being determined by said predetermined change of velocity for said predetermined length of time.

4. The game as claimed in claim 1 wherein said drive means of said mobile target causes said mobile target to continuously move in a circular path and wherein said control means is operative on said drive means to cause said mobile target to travel for a predetermined distance in a line tangential to said circular path in response to detection of said emitted radiation by said sensing means, said predetermined distance being determined by said predetermined length of time.

5. The games as claimed in claim 1 wherein there are provided at least two means for emitting light of differing radiation and wherein said mobile target is provided with at least two sensing means responsive to radiation from respective light emitting means.

6. A game testing the ability of players, which comprises:

a mobile target;

means for emitting a narrow beam of radiation;

sensing means on said mobile target responsive to said radiation of said emitting means;

drive means on said mobile target for displacing said mobile target, said drive means of said mobile target causing said mobile target to continuously move in a circular path; and control means for controlling said drive means in response to sensed radiation, said control means being operative on said drive means to cause said mobile target to undergo a predetermined change in velocity for a predetermined time, said change in velocity for a predetermined time taking the form of the mobile target traveling for a predetermined distance in a line tangential to said circular path in response to detection of said sensed radiation, said predetermined distance being determined by said tangential line of travel for said predetermined length of time.

7. The game as claimed in claim 6 and comprising two radiation emitting means and a single sensing means and wherein said mobile target is caused to move in a tangential line of travel a predetermined distance in one direction in response to said radiation being detected by said sensing means when said mobile target is at a given point in its circular path and to move in a tangential line of travel a predetermined distance in the opposite direction in response to detection of radiation by said sensing means when said mobile target is at a point essentially 180 degrees away from said given point, said predetermined distance being determined by said tangential line of travel for said predetermined length of time.

8. The game as claimed in claim 6 wherein said mobile target is provided with a plurality of sensing means and wherein said control means causes said mobile target to travel different predetermined distances in response to radiation sensed by respective ones of said sensing means.

* * * * *